United States Patent [19]

Schmidt et al.

[11] Patent Number: 4,531,111

[45] Date of Patent: Jul. 23, 1985

[54] VOLTAGE DIVIDER IN THIN- OR THICK-FILM TECHNOLOGY

[75] Inventors: Lothar Schmidt, Stuttgart; Ulrich Goebel, Reutlingen, both of Fed. Rep. of Germany

[73] Assignee: Robert Bosch GmbH, Stuttgart

[21] Appl. No.: 513,961

[22] PCT Filed: Oct. 28, 1982

[86] PCT No.: PCT/DE82/00209

§ 371 Date: Jul. 6, 1983

§ 102(e) Date: Jul. 6, 1983

[87] PCT Pub. No.: WO83/01708

PCT Pub. Date: May 11, 1983

[30] Foreign Application Priority Data

Nov. 7, 1981 [DE] Fed. Rep. of Germany ..... 3144252

[51] Int. Cl.[3] ..... H01C 10/16

[52] U.S. Cl. ..... 338/195; 323/298; 323/354

[58] Field of Search ..... 323/297, 298, 353, 354; 338/195

[56] References Cited

U.S. PATENT DOCUMENTS 4,100,525 7/1978 Denes ..... 338/195
4,284,970 8/1981 Berrin et al. ..... 338/195
4,475,099 10/1984 Praria ..... 338/195

FOREIGN PATENT DOCUMENTS 2518969 12/1976 Fed. Rep. of Germany .

*Primary Examiner*—William H. Beha, Jr.
*Assistant Examiner*—Jeffrey Sterrett
*Attorney, Agent, or Firm*—Frishauf, Holtz, Goodman & Woodward

[57] ABSTRACT

A calibratable voltage divider made by thin-film or thick-film technology formed by a flat film is an ohmic voltage divider resistor connected to have current flow through it. At least one tap is provided to tap off a desired divider voltage. The ohmic voltage divider resistor includes a single, coherent first resistance zone (10), which has one area for supplying current and another for taking current away, each being connected with a respective connection conductor (11, 12). The tap is made in the form of a second resistance zone (13) connected with the first resistance zone (10) between the current supply, and current drainage areas, and a take-off electrode (14) is attached to the second resistance zone (13). As needed, one or two cuts (16, 17), which intersect the equipotential lines are made to partially separate the second resistance (13) from the resistor (10) zone extended far enough that the potential attains the desired value at the take-off electrode (14) of the tap. The cut is so placed with respect to the coherent resistance zone that its length, or extent, hardly affects the resistance of the coherent zone between the current supply and drainage areas.

15 Claims, 8 Drawing Figures

VOLTAGE DIVIDER IN THIN- OR THICK-FILM TECHNOLOGY

Figure 1:
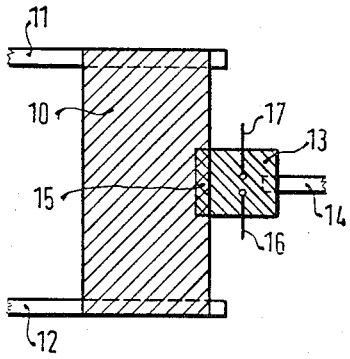

The invention relates to a voltage divider.

BACKGROUND

Voltage dividers using thin- or thick-film technology are already known. Such ohmic voltage divider includes resistor through which current flows; they usually are two individual resistors connected by a metal film. The metal film simultaneously acts as the tap for tapping off the desired divider voltage. These voltage dividers have the disadvantage, however, that calibration of the divider resistance to a desired value is possible only by increasing the values of the individual resistors making up the voltage divider. As a result the total resistance of the divider and the distribution of electric current and potential in the voltage divider resistors are varied thereby as well.

THE INVENTION

It is an object to provide a film-type voltage divider which provides an accurately calibrated take-off voltage from a voltage divider tap without, essentially, changing the resistance values of the resistor forming the voltage divider upon calibrating the tap-off voltage.

Briefly, a single coherent film resistor is provided, made, for example, by thick film or thin film technology. The film, for example, of rectangular outline, has an electrical supply conductor and a drainage conductor connected to opposite smaller sides of the rectangle to form at the film, current supply and drainage areas, between which the coherent resistor film extends. The tap is formed as a second resistance film zone, electrically connected to the coherent resistance film zone, between the connection or end areas, the second resistance film zone then being calibrated to provide the desired tap-off voltage, independently of the value of the first or main film zone. A tap off conductor or electrode is electrically connected to the second resistance film zone.

The voltage divider according to the invention has the advantage that by shifting the alteration required for calibration into the second resistance zone belonging to the tap, a predetermined equipotential line can be selected at the take-off electrode of the tap without thereby having to substantially vary the actual voltage divider resistance or its potential distribution. A particularly advantageous type of alteration, effected in the second resistance zone for the sake of calibration, is the formation of a cut, by laser or sand blasting. In another advantageous solution to the calibration problem a single, coherent voltage divider resistor is used and a cut partially separates the coherent resistor film to form these and the second zone which is also used at the same time as a tap.

DRAWING

Figure 2:
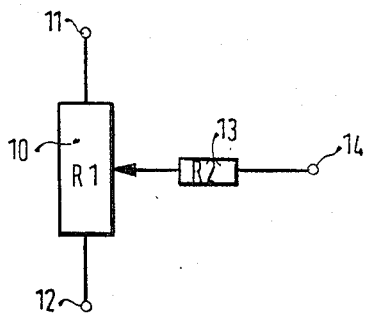

Exemplary embodiments of the voltage divider according to the invention are shown in the drawing and explained in further detail in the following description. Shown are:

FIG. 1, the basic variant of a voltage divider according to the invention, which is realized by thick-film technology and is seen in a plan view;

FIG. 2, the equivalent circuit diagram for the voltage divider shown in FIG. 1; and FIGS. 3–8, further variants of voltage dividers according to the invention, realized by thick-film technology and seen in plan view.

DESCRIPTION OF THE INVENTION

The voltage divider shown in FIGS. 1 and 2 includes an ohmic voltage divider resistor $R_1$ (FIG. 2) connected to have electric current flow through it. This voltage divider resistor comprises a single coherent first resistance film 10 realized by film technology, a connection conductor 11 serving to supply electric current and a connection conductor 12 serving to drain, or carry away electric current; the connection conductors 11 and 12 are formed as conductive tracks (FIG. 1). The first resistance zone 10 forms a rectangular area, the length of which is greater than its width. The connection conductors 11 and 12 are attached to the narrow sides of this rectangular area and along these narrow sides they overlap the first resistance zone 10.

A tap serving to tap off the desired divider voltage is also provided. This tap comprises a second resistance zone 13 made by film technology and a take-off electrode 14 attached to this zone 13 and formed as a conductive track. The two resistance zones 10 and 13 abut one another in an area 15, which is located at one of the long sides of the resistance film 10, in such a manner that a good electrical contact is established between these two resistance zones 10 and 13 in this area 15. The equivalent circuit of zone 13 is shown at RZ in FIG. 2.

For calibration the voltage divider, a first laser-beam cut or sand-blast cut 16 and a second laser-beam cut or sand-blast cut 17 are made in the second resistance zone 13. The two cuts 16 and 17 extend parallel to the long side of the first resistance zone 10; that is, they intersect the equipotential lines resulting from the operation of the voltage divider. When the voltage divider $R_1$, $R_2$ is calibrated, these two cuts 16 and 17 are effected to such an extent that the potential has attained the desired value at the take-off electrode 14 of the tap.

If the material comprising the first resistance zone 10 and the material comprising the second resistance zone 13 are identical, the effective value of the resistor $R_1$ is affected relatively severely by the calibration. If this effect is undesirable, then in accordance with the invention the material making up the second resistance zone 13 is selected to be of higher resistance than that forming the first resistance zone 10, so that the effective voltage divider resistance embodied by the first resistance zone 10 and the distribution of its potential are not altered substantially by the calibration.

Figure 3:
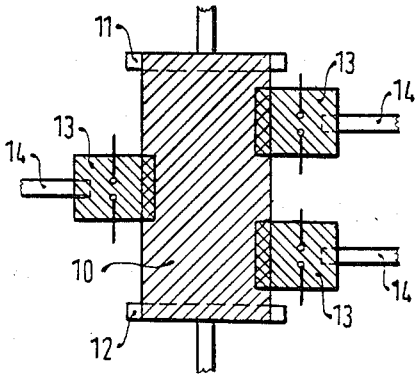

In FIG. 3, a second exemplary embodiment of a voltage divider according to the invention is shown, in which one tap 13, 14 is disposed on one of the two long sides of the first resistance zone 10 and two taps 13, 14 are disposed on the other long side of the first resistance zone 10. Calibration is performed in the same manner as in the exemplary embodiment of FIGS. 1 and 2.

Figure 4:
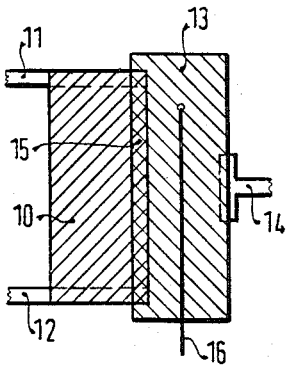
Figure 5:
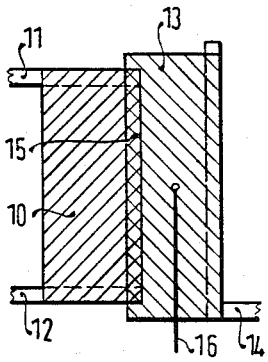
Figure 6:
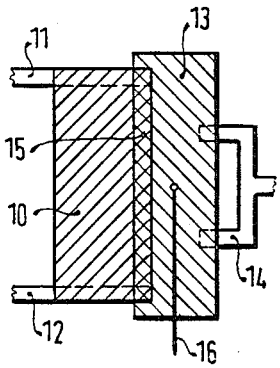

In the exemplary embodiments of FIGS. 4–6, the first resistance zone 10 is embodied as an elongated rectangle, as in the exemplary embodiments of FIGS. 1 and 3. The second resistance zone 13 is embodied in the form of a strip, like the first resistance zone 10. The second resistance zone 13 extends parallel to the first resistance zone 10 and is connected via a contacting zone 15 with the first resistance zone 10. The contact zone 15 extends over the entire length of the first resistance zone 10. For the purpose of calibration, a laser-beam or sand-blast cut 16 is provided in the second resistance zone 13, extending parallel to the longitudinal direction of the two resistance zones 10, 13. The take-off electrode 14 for the divider voltage to be tapped off is embodied differently in each of the various exemplary embodiments shown in FIGS. 4–6. In all three exemplary embodiments, however, the depth of the laser cut 16 primarily determines the level of the divider voltage to be tapped off at the take-off electrode 14. The divider voltage taken off at the take-off electrode 14 may thereby be from 0 to 100% of the voltage applied to the connection conductors 11 and 12. In the exemplary embodiments of FIGS. 4–6, the varying geometry selected for the take-off electrode 14 makes it possible to adapt the calibration characteristic curve to a given requirement.

Figure 7:
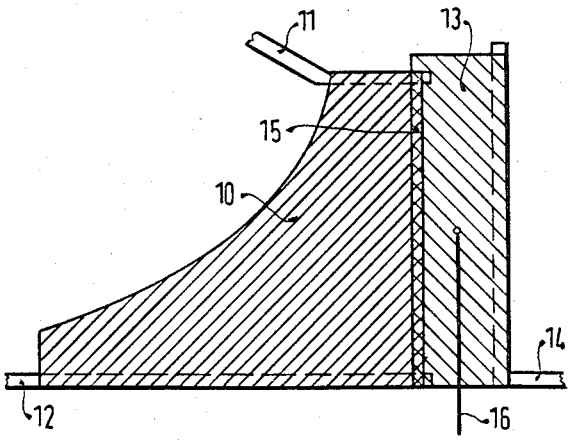

The exemplary embodiment shown in FIG. 7 serves to generate arbitrarily selectable, monotonic calibration characteristic curves and to compensate for nonlinearities of a circuit. This exemplary embodiment differs from the exemplary embodiments of FIGS. 4–6 in that here the first resistance zone 10 forming the ohmic voltage divider resistor $R_1$ widens from the vicinity of its first connection conductor 11 to the vicinity of its second connection conductor 12. The boundary between the two resistance zones 10 and 13 is a straight line, however, in the contacting zone 15, and the second resistance zone 13 is embodied in the form of a strip. The laser cut 16 extends within the resistance zone 13 parallel to its longitudinal direction. Since here again the second resistance zone 13 extends over the entire length of the first resistance zone 10 and even somewhat beyond it at the upper end, here again it is possible to take off a voltage at the take-off electrode 14 which is between 0 and 100% of the voltage applied between the connection conductors 11 and 12.

Figure 8:
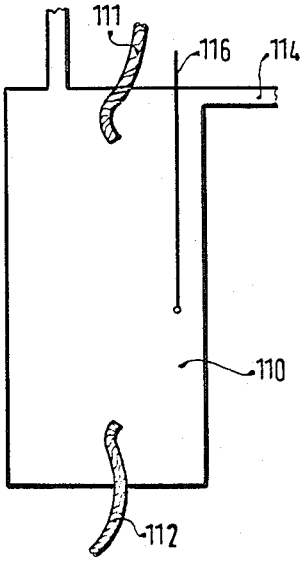

In the exemplary embodiment shown in FIG. 8, the entire voltage divider comprises a single resistance film 110. This resistance film 110 simultaneously embodies both the ohmic voltage divider resistor $R_1$ through which the flow of electric current passes and the tap 114. The resistance film 110 has respective areas serving to supply and to take away current, each connected to one current connection conductor 111, 112. The connection conductors 111, 112 may be formed as bonded wires. In order to generate a divider voltage at the tap 114, which is a component of the resistance film 110, a cut 116 is introduced into the coherent resistance film, at the side of the tap 14, extending between the portion of this film which has the tap 114 and the region of this film which carries the current between the current connection conductors. The cut 116 is extended far enough that the potential at the tap 114 attains the desired value. Since the cut is close to the side of the film 110, (see FIG. 8) and separates off only a small portion of the film 110, the resistance of the film 110 between the conductors 111, 112 changes only insignificantly even if the art is made longer. The divider voltage taken off at the tap 114 may again amount to between 0 and 100% of the voltage applied to the connection conductors 111 and 112, depending upon the depth of the laser cut 116.

The invention is not restricted to the exemplary embodiments described in conjunction with the drawings. In particular, in the exemplary embodiments according to FIGS. 1 and 3–7, the two resistance zones 10 and 13 may form a single, coherent zone if the two zones 10 and 13 are of the same material. In that case, the contacting zone 15 may thus be dispensed with.

We claim:

1. A calibratable voltage divider, to provide a calibrated take-off voltage, having a resistance film (R1, 10) having a geometric aspect which defines two opposite sides;

a first current connection conductor (11) connected to the resistance film at a first side;

a second current conductor (12) connected to the resistance film at a second side opposite the first side;

the resistance film including a main single film resistance zone (10) having unitary first and second areas to which said first and second current connection conductors, respectively, are connected, so that, upon energization of the current connection conductors, current will flow through the end areas and through said single resistance film zone (10) and a voltage drop will occur across said single resistance film zone;

and a tap, to tap-off a voltage from said resistance zone, wherein the tap comprises a second resistance film zone (13) electrically connected to said main resistance film zone (10) at a position between said areas, and a tap-off electrode (14) electrically connected to said second resistance film zone (13); and wherein the second resistance film zone has a resistance value calibrated to provide the desired tap-off voltage whereby, upon calibration of the second resistance film zone (13), the resistance value of the main resistance film zone (10) is not essentially affected.

2. Voltage divider according to claim 1 wherein said second resistance zone (13) comprises an electrical resistance film separated, at least in part, by a laser cut, or a sand blast cut (16, 17) formed in the second resistance film, the cut intersecting equipotential lines occuring upon current flow between said areas, and extending without the second resistance zone to a point at which the voltage at the take-off electrode (14) has said desired tap-off voltage.

3. Voltage divider according to claim 1 wherein said resistance film (R1, 10) essentially is of rectangular shape;

said areas are formed by end portions of the rectangular resistance film, the first and second current connection conductors comprising conductive tracks electrically connected with said areas.

4. Voltage divider according to claim 3 wherein the conductive tracks (11, 12) electrically connected with said areas of the first resistance zone extend over the entire end portions of said coherent film resistance zone (16).

5. Voltage divider according to claim 1 wherein said second resistance film zone (13) comprises a material which has a higher square resistance than the material comprising the main single resistance film zone (10), whereby variation in the resistance of the second resistance film zone for calibration will not essentially affect the resistance (R1) of said main single resistance film zone (10).

6. Voltage divider according to claim 1 wherein the second resistance film zne (13) comprises a film material different from that of the main, single resistance film zone (10), and said materials are positioned with a slight overlap with respect to each other.

7. Voltage divider according to claim 1 wherein the main single resistance film forming the voltage divider resistance film (R1) forms a thin strip;

said first and second current connection conductors are spaced from each other, said film strip extending between the first and second current connection conductors (11, 12).

8. Voltage divider according to claim 7 wherein the area of the second resistance film zone (13) communicating with said film strip extends over only a portion of the length of the first resistance zone (10) formed by said strip.

9. Voltage divider according to claim 8 wherein a plurality of taps are located along the length of said strip.

10. Voltage divider according to claim 8 wherein a plurality of taps are provided, at least one tap being located on one side of the strip and another tap being located on the other side of the strip.

11. Voltage divider according to claim 7 wherein the second resistance film zone (13) forms a strip communicating over the entire length of the strip-like main single film resistance zone (10);

and wherein a separating cut (16) is formed within the second resistance film zone (13), the cut extending parallel to the longitudinal direction the strip, and having a length to provide the resistance value required to provide the desired tap-off voltage.

12. Voltage divider according to claim 1 wherein the main resistance film zone (10) forms an ohmic voltage divider resistor film extending between said first and second areas in which the width of the resistance film zone varies along the length thereof between said areas.

13. Voltage divider according to claim 12 wherein the second resistance film zone (13) forms a strip communicating over the entire length of the strip-like main single film resistance zone (10);

and wherein a separating cut (160) is formed within the second resistance film zone (13), the cut extending parallel to the longitudinal direction of the strip, and having a length to provide the resistance value required to provide the desired tap-off voltage. .

14. A calibratable voltage divider, to provide a calibrated take-off voltage, having a resistance film (R1, 10) having a geometric aspect which defines two opposite sides;

a first current connection conductor (11) connected to the resistance film at a first side;

a second current conductor (12) connected to the resistance film at a second side opposite the first side;

the resistance film including a main single coherent film resistance zone (10) having unitary first and second areas to which said first and second current connection conductors, respectively, are connected, so that, upon energization of the current connection conductors, current will flow through the end areas and through said single coherent resistance film zone (10) and a voltage drop will occur across said single coherent resistance film zone;

and a tap, to tap-off a voltage from said resistance zone, wherein the tap comprises a second resistance film zone (13) electrically connected to said main coherent resistance film (10) and partially separated from said main coherent resistance film zone (10) by an electrical discontinuity in form of a cut (16, 116) through said main single coherent resistance film zone (10), said cut being located in a region of said coherent film zone (10) where the length or extent of the cut does not materially influence current flow or distribution of current flow between said areas and through said coherent zone;

and a tap-off conductor (14, 114) connected to said second resistance film zone.

15. Voltage divider according to claim 14 wherein the main single coherent film resistance zone (10) is essentially rectangular;

and the electrical discontinuity is formed by the cut (16, 116) located close to and adjacent one longitudinal side of the rectangular main single coherent resistance film zone (10) to separate said main coherent film resistance zone (10) from the second resistance film zone and defining a portion thereof.

* * * * *